United States Patent [19]

Hahmann

[11] Patent Number: 4,763,691

[45] Date of Patent: Aug. 16, 1988

[54] HYDRAULIC CONTROL VALVE

[75] Inventor: Wolfgang Hahmann, Kempen, Fed. Rep. of Germany

[73] Assignee: Barmag Barmer Maschinenfabrik Aktiengesellschaft, Remscheid, Fed. Rep. of Germany

[21] Appl. No.: 903,270

[22] Filed: Sep. 3, 1986

[30] Foreign Application Priority Data

Sep. 3, 1986 [DE] Fed. Rep. of Germany ..... 3531354

[51] Int. Cl.[4] ..... F15B 11/00

[52] U.S. Cl. ..... 137/596.14; 91/522; 137/596.18

[58] Field of Search ..... 137/596.18, 596.14, 137/59.16; 60/452, 427; 91/522

[56] References Cited

U.S. PATENT DOCUMENTS 4,051,868 10/1977 Andersen ..... 137/596.13
4,570,672 2/1986 Wilke ..... 137/596.14 X
4,616,674 10/1986 Bardoll ..... 137/596.18
4,649,951 3/1987 Tardy ..... 137/596.13 X

FOREIGN PATENT DOCUMENTS 1168256 4/1964 Fed. Rep. of Germany .
1168257 4/1964 Fed. Rep. of Germany .
2234313 9/1977 Fed. Rep. of Germany .
3421492 12/1985 Fed. Rep. of Germany .
2076182 11/1981 United Kingdom ..... 137/596.18

*Primary Examiner*—William E. Wayner
*Attorney, Agent, or Firm*—Bell, Seltzer, Park & Gibson

[57] ABSTRACT

A hydraulic control valve is disclosed which is adapted to independently control the flow of hydraulic fluid to several consumer lines. The control valve includes a housing having a central bore, a pair of axially spaced apart consumer lines comunicating with the bore, a tank line communicating with the bore and positioned between the consumer lines, and a pair of hydraulic inlet lines communicating with the bore on the outer side of respective ones of the cosumer lines. A pair of slide valves are positioned in the bore, and each slide valve is supported in a neutral position by a coil spring. The two slide valves may be independently moved from their neutral position by a hydraulic control system, so that each slide valve is adapted to selectively establish communication between one of the consumer lines and the tank line, and between such consumer line and one of the hydraulic inlet lines.

17 Claims, 1 Drawing Sheet

HYDRAULIC CONTROL VALVE

BACKGROUND OF THE INVENTION

The present invention relates to a hydraulic control valve adapted for independently controlling the flow of a hydraulic fluid to several consumer lines.

In prior hydraulic control systems which require the independent control of several consumer lines, it is customary that a completely separate valve be provided for each of the consumer lines. This of course involves a substantial expenditure for the required equipment.

It is accordingly an object of the present invention to provide a single hydraulic control valve which is adapted to independently control at least two consumer lines. In this regard, the two consumer lines may be commonly connected to control the forward and return strokes of a single consumer, or they may be connected to control the forward stroke of two separate consumers, or they may be commonly connected to control only the forward stroke of one consumer.

SUMMARY OF THE INVENTION

The above and other objects and advantages of the present invention are achieved in the embodiments illustrated herein by the provision of a hydraulic control valve which comprises a housing having a bore therein, first and second axially spaced apart consumer lines communicating with the bore, tank line means communicating with the bore and positioned adjacent each of the first and second consumer lines, and hydraulic inlet line means communicating with the bore and disposed adjacent each of the first and second consumer lines. In addition, first and second slide valves are slideably mounted in the bore, with each of the slide valves being slideable along the bore to selectively establish communication between one of the consumer lines and the inlet line means, and between the one consumer line and the tank line means. Further, biasing means is provided which is operatively connected to each of the first and second slide valves for biasing the same to a predetermined position in the bore, and control means is provided for selectively moving at least one of the first and second slide valves axially along the bore and against the force of the biasing means, so as to effect the desired communication between the consumer line, inlet line means, and tank line means.

In the preferred embodiments, the control means includes means for selectively and independently moving each of the slide valves axially along the bore. Also, the bore defines a normal plane in the longitudinal center thereof, and the two consumer lines are disposed on opposite sides of the longitudinal center, and the slide valves are disposed in mirror image relationship to each other on opposite sides of the longitudinal center. This simplifies the manufacture of the control valve, since the two slide valves may be of identical construction.

It is also preferred that the tank line means comprises a single tank line which communicates at the longitudinal center of the bore and between the two consumer lines, which prevents the control of the slide valves from being influenced by the pump pressure or the consumer pressure. Also, the inlet line means preferably comprises two separate inlet lines, which are disposed on the side of respective ones of the consumer lines opposite the tank line. Each slide valve and the adjacent portion of the bore are thereby designed and constructed to form a 3/3-way valve.

The two inlet lines are connected to a suitable pump or other source of pressurized fluid. Also, each of the slide valves includes a control shoulder at one end, a guide shoulder at the opposite end, and a reduced diameter portion extending therebetween. Also, in one embodiment, each inlet line communicates with the bore at a location generally aligned with the reduced diameter portion of the associated slide valve, and each consumer line communicates with the bore at a location adjacent the control shoulder of the slide valve. Further, the control shoulder preferably is dimensioned so as to positively cover the associated consumer line, so that all of the lines may be closed in a neutral axial position of the slide valve.

It is also preferred that each slide valve have its own control means, which supplies a displacement force only in one direction, particularly when the displacement force is hydraulically actuated. This arrangement could be disadvantageous in certain instances, but in accordance with one embodiment of the present invention, this disadvantage is eliminated in that the slide valves are adapted to abut each other at their free ends, so that each valve is displaced against the direction of its force of displacement by the actuating force of the other slide valve. In this embodiment, the abutting ends of the two slide valves have a specified clearance between each other in their neutral positions, and this clearance defines the slide valve movement which is possible without a mutual influence. The magnitude of the specified clearance is determined by the desired functions of the valve, and in certain cases the clearance may equal zero in the neutral position of the slide valves. Preferably, the slide valves and their control systems are designed so that a defined neutral position exists, and a constructionally simple arrangement for achieving this purpose is to provide each slide valve with a prestressed fixed spring which is operable in both directions of movement.

One embodiment of the control valve of the present invention which is suitable for actuating a consumer in several speed steps, distinguishes itself in that the slide valves are independently controlled in their axial movement, and each consumer line is connected with the tank line at the neutral position of the slide valves, which is determined by the fixed springs.

BRIEF DESCRIPTION OF THE DRAWINGS

Some of the objects and advantages of the present invention having been stated, others will appear as the description proceeds, when taken in conjunction with the accompanying drawings, in which.

DESCRIPTION OF THE PREFERRED EMBODIMENT

Figure 1:
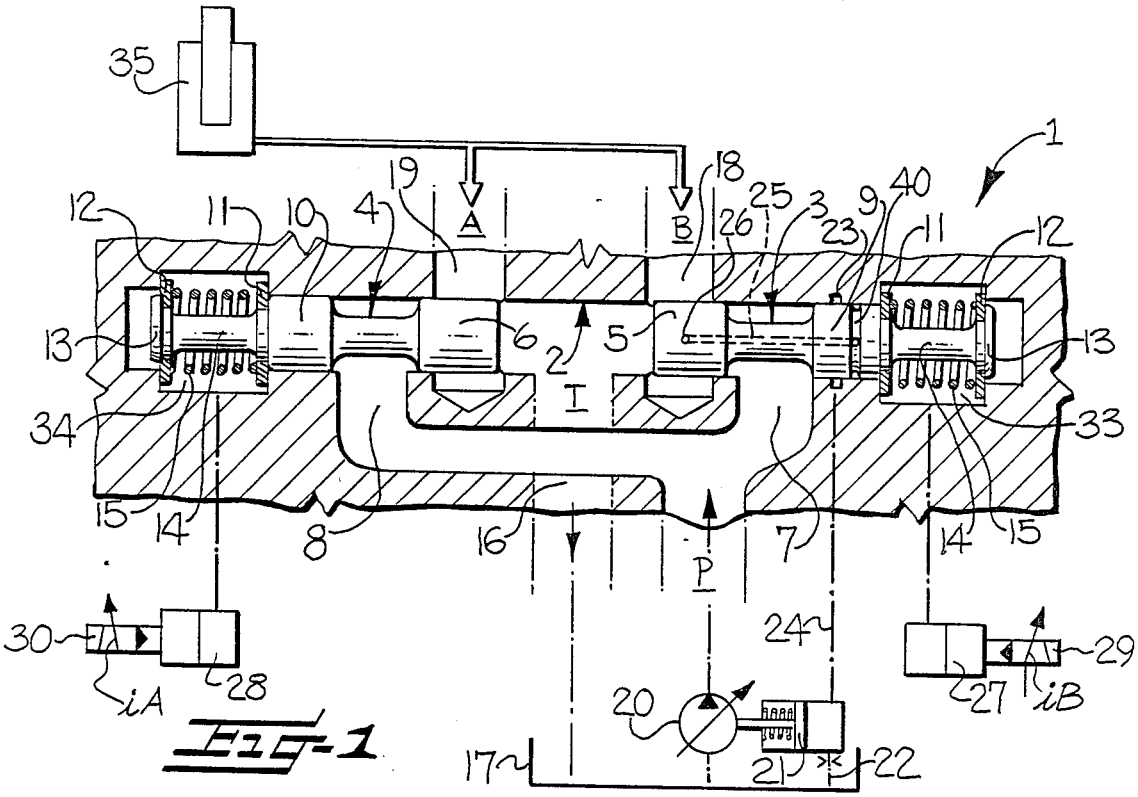
FIG. 1 is a schematic view of a hydraulic control valve which embodies the features of the present invention.

Referring more particularly to FIG. 1, a hydraulic control valve is disclosed which includes a housing 1 having a cylindrical control bore 2 therein. First and second axially spaced apart consumer lines 18 and 19 (also labeled B and A respectively) communicate with the bore, and a tank line 16 (also labeled T) communicates with the bore at a location between the first and second consumer lines. First and second hydraulic inlet lines 7 and 8 communicate with the bore and are disposed adjacent respective ones of the consumer lines 18 and 19 on the side thereof opposite the tank line 16. The inlet lines 7 and 8 communicate with a common pump line P. The tank line 16 is positioned along the axial center of the control bore 2, and the pump line P is operatively connected to a variable output, e.g. variable speed pump 20.

First and second slide valves 3 and 4 are disposed coaxially in the bore 2, and each slide valve includes a cylindrical control shoulder 5,6 which is generally aligned with the associated consumer line, a cylindrical slide shoulder 9,10 positioned on the opposite side of the associated inlet channel, and a portion of reduced diameter between the control shoulder and slide shoulder.

The control shoulders 5,6 are axially dimensioned to close the associated consumer line 18,19 in a predetermined axial position of the slide valve, and upon movement of the slide valve, communication may be effected between the associated consumer line and the tank line, and between the associated consumer line and the associated inlet line. Each slide valve and its adjacent portion of the bore are therefore designed and constructed as a 3/3-way valve.

The bore 2 includes pilot chambers 33,34 of enlarged diameter, and which are operatively associated with the slide valves 3,4 respectively. More particularly, each pilot chamber is located on the side of the slide shoulder of the associated valve which is opposite the control shoulder thereof. Biasing means is disposed in each of the pilot chambers, for resiliently supporting the associated slide valve at a predetermined position in the bore, and this biasing means includes a coil spring 15 which is coaxially mounted about an extension 14 which is threadedly connected to the slide valve. The extension 14 supports two annular rings 11 and 12, with the ring 12 being further supported by a threaded end cap 13 which is attached to the extension 14. The spring 15 is supported between the two rings 11 and 12 under an initial compressive force, and the rings 11 and 12 are also supported against the shoulders defined by the enlarged diameter of the pilot chambers. The ring 11 also engages the shoulder formed at the end of the guide shoulder 9 or 10 of the slide valve.

Control means is also provided for selectively moving the two slide valves axially along the bore 2 and against the force of the coil springs 15, so as to effect selective communication between the associated consumer line and inlet line, and between the associated consumer line and tank line. The valves may also be moved to an axial location closing all such communication. More particularly, each guide shoulder 9,10 is biased in the pilot chamber 33 or 34 by a pilot pressure provided by the servo valves 27,28.

In the embodiment of FIG. 1, the springs 15 are selected so that each slide valve 3 and 4 opens the connection between the consumer line 18 or 19 and the tank line 16, when there is no pressure in the pilot chamber, i.e. the neutral position. The servo valves 27 and 28 are controlled by electromagnets 29,30, which are in turn controlled by the variable currents iB and iA, and in the absence of a current, the slide valves 3 and 4 are not biased by any pilot pressure. The slide valves thus occupy their neutral position, and as noted above, they open communication between their associated consumer line and the tank line 16.

When the electromagnets are energized by a predetermined standby current R, the control slide valves 3 and 4 are biased by the pilot pressure, so that the control shoulders completely cover the consumer lines 18 and 19, and so that all connections are closed. When the electro-magnets are further energized by the variable operating current iB,iA up to a maximum current S, the pilot pressures which are proportional to the current also increase, and the slide valves are further displaced so that openings of controlled widths result between the respective consumer lines 18 and 19 and the associated inlet lines 7 and 8. It will also be noted that in the embodiment of FIG. 1, the two consumer lines 18 and 19 are connected to a single consumer 35.

Table 1 below illustrates the switching possibilities as a function of the control currents iB or iA, respectively, which energized the electromagnets 29,30 of the two servo valves 27,28.

TABLE 1

| Switching Position | Electromagnet Current iA | iB | Connection | |
|---|---|---|---|---|
| O | O | O | A–T; B–T | To lower rapidly |
| 1a | R | O | B–T; | To lower normally |
| 1a, b | R | O < i < R | B–T; | To lower at a crawl |
| 1c | R | R | | Stop |
| 2a | R < i < S | R | P–A; | To raise at a crawl |
| 2a, b | S | R < i < S | P–A; P–B; | To raise normally |
| 2c | S | S | P–A; P–B; | To raise rapidly |

The pump 20 which supplies a pressurized hydraulic fluid may be a variable speed pump, and the output of the pump is controlled by an adjustment means 21, which is schematically illustrated as a cylinder-piston unit. The piston is biased by a pressure against the force of a spring, and for this purpose, the rear end of the cylinder is connected to a feedback line 24 and to a line 22 having a very narrow throttle therein and which leads to the tank 17. To deliver the load pressure to the line 24, the control shoulder 5 of the slide valve 3 has a radial bore 26, which communicates with an axial duct 25. The axial duct 25 in turn communicates via a radial bore with an annular groove 40 which is provided on the guide shoulder 9. In the control position of the slide valve 3, in which the consumer line 18 is connected with the inlet channel 7, the groove 40 of the guide shoulder 9 is aligned with an annular groove 23 in the housing 1 at the periphery of the control bore 2. The groove 23 is in turn connected with the feedback line 24. Thus, the load pressure is reported to the adjusting means 21, and it is thereby possible to adjust the output of the pump 20 to the actual load conditions.

Figure 2:
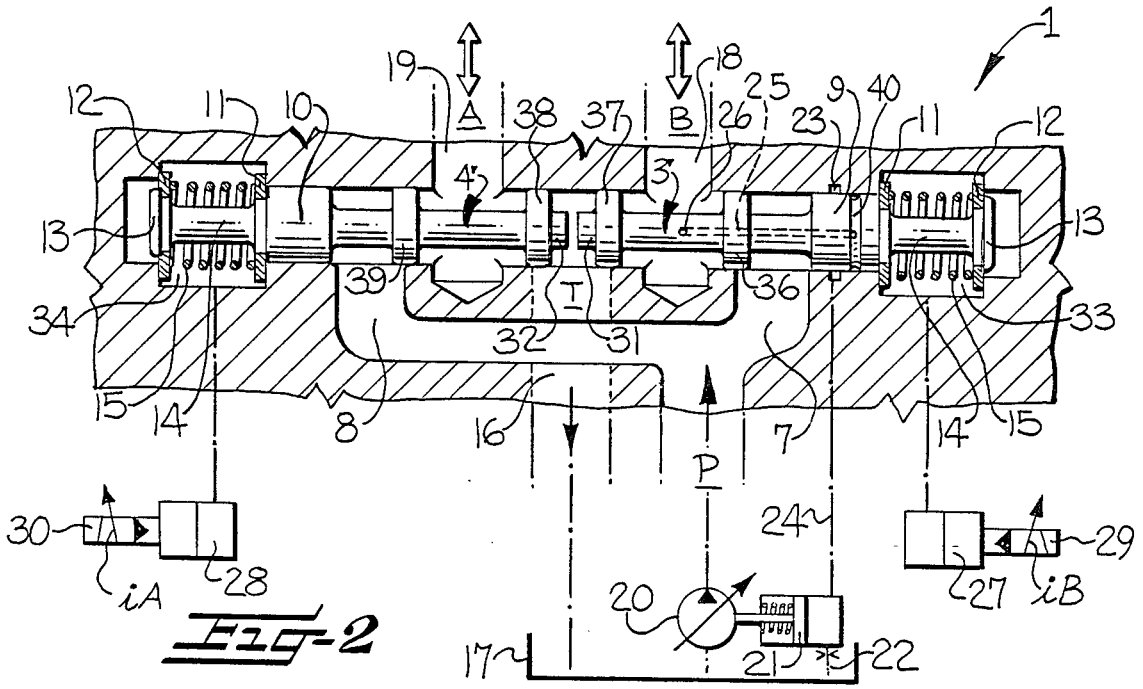
FIG. 2 is a schematic view illustrating a further embodiment of the present invention.

Referring now to the embodiment of FIG. 2, there is disclosed a housing 1 which includes a central bore 2 therein, and first and second slide valves 3' and 4' are positioned for axial movement in the bore 2. Each slide valve 3' and 4' has a control shoulder which is composed of a pair of shoulder sections 36,37, and 38,39, respectively. The shoulder sections of each valve are axially spaced apart so as to be adapted to close communication between the associated consumer line and both the tank line and the associated inlet line when the slide valve is positioned in the neutral position as seen in FIG. 2. The control shoulder sections also will be seen to permit communication from the consumer line to either the tank line or the inlet line upon axial movement. Thus, each control slide valve is designed and constructed to form, with its adjacent bore portion, a 3/3-way valve.

The common pump line P branches to form the inlet lines 7 and 8, which communicate with the control bore 2, and each slide valve is resiliently supported in its neutral position by a restraining spring 15 in the manner described above with respect to the embodiment of FIG. 1. Also, each slide valve 3',4' is biased by the pressure in the pilot chamber 33 or 34, which is controlled by the associated servo valves 27,28 in the manner described above.

In the absence of a control current iB,iA to the electromagnets 29,30, the slide valves are not biased by a pilot pressure. The slide valves thus occupy their neutral position and close the consumer lines 18 and 19 in the manner noted above. When the electromagnets 29,30 are energized by a standby current R, the slide valves 3' and 4' are biased by the pilot pressure so that the shoulder sections 37,38 connect the consumer lines 18,19 with the tank line 16.

When the electromagnets are further energized by increasing the variable current up to a maximum current S, pilot pressures which are proportional thereto are generated, and the slide valves 3',4' are displaced so that openings of different widths may be provided between the consumer lines and the tank line 16.

It will be noted however that each of the slide valves 3',4' is provided with an abutting end 31,32, respectively, and these abutting ends oppose each other in the area of the axial center of the bore 2. In the neutral position, there is a predetermined clearance between the abutting ends 31 and 32, and the predetermined clearance is dimensioned so that the abutting ends 31,32 contact each other only after the consumer lines 18 and 19 have been opened to the tank line 16. When one of the slide valves is biased by a higher current than the standby current, such slide valve will displace the other slide valve in such a manner that the consumer line, which is controlled by the other slide valve, is connected to the pump inlet line. As a result, it is possible to independently control each slide valve in the direction of the force of displacement. When controlled beyond the specified clearance, both slide valves influence each other, so that both consumer lines can be interactively controlled.

The slide valve 3' has a radial bore 26 between its control shoulder sections 36,37 and the bore 26 terminates in an axial duct 25, which leads in turn to a radial bore which communicates with a groove 40 in the guide shoulder 9. In the control position of the slide valve 3' in which the consumer line 18 is connected with the pump inlet line 7, the groove 40 communicates with a groove 23 housing 1 at the periphery of the bore 2, and the groove 23 is in turn connected with the load feedback line 24. This permits load pressure to be reported back to the adjusting means 21 of the pump 20, so that its discharge output can be adapted to the actual load requirements in the manner described above.

In the illustrated embodiment of FIG. 2, various switching possibilities result as a function of the control current iB or iA, and which respectively bias the electromagnets 29,30 of the servo valves 27,28 as is shown for example in the following Table 2 for a consumer unit which can be biased in both directions via the consumer lines 18 and 19.

TABLE 2

| Switching Position | Electromagnet Current iA | Electromagnet Current iB | Connection | Function |
|---|---|---|---|---|
| O | O | O | O | Stop Fail Safe |
| 1 A | R | O | A–T; O | To relieve A |
| 2 A | iA > R | O | A–T; P–B | Operation B |
| 1 B | O | R | B–T; O | To relieve B |
| 2 B | O | iB > R | B–T; P–A | Operation A |
| 3 | R | R | A–T; B–T | Floating position |

In the drawings and specification, there has been set forth a preferred embodiment of the invention, and although specific terms are employed, they are used in a generic and descriptive sense only and not for purposes of limitation.

That which I claim is:

1. A hydraulic control valve adapted for controlling a plurality of consumer lines, and comprising a housing having a bore therein, first and second axially spaced apart consumer lines communicating with said bore, a tank line communicating with said bore and positioned between said first and second consumer lines, first and second hydraulic inlet lines communicating with said bore, with each inlet line being disposed adjacent a respective one of said first and second consumer lines, and on the side thereof opposite said tank line, first and second slide valves slideably mounted in said bore on respective opposite sides of said tank line, with each of said slide valves including a cylindrical control shoulder which is administered so as to be adapted to close the associated consumer line when the slide valve is positioned at a predetermined first axial position in said bore, slide valve position means for selectively and independently moving each of said first and second slide valves between three positions, which include said predetermined first axial position, a second axial position establishing communication between the associated consumer and inlet lines, and a third axial position establishing communication between the associated consumer line and said tank line.

2. The hydraulic control valve as defined in claim 1 wherein said slide valve positioning means includes biasing means operatively connected to each of said first and second slide valves for resiliently supporting the same at said third axial position, and control means for selectively and independently moving each of said slide valves against the force of said biasing means to either said predetermined first axial position or said second axial position.

3. The hydraulic control valve as defined in claim 2 wherein said control means is adapted to move one of said slide valves in one axial direction, and the other of said slide valves in the opposite axial direction.

4. The hydraulic control valve as defined in claim 3 wherein each of said slide valves further includes a cylindrical slide shoulder which is axially spaced from said control shoulder in the direction extending away from said tank line, and a reduced diameter portion extending between and interconnecting said control shoulder and said slide shoulder.

5. The hydraulic control valve as defined in claim 4 wherein said bore includes a pilot chamber positioned adjacent said slide shoulder of each slide valve, and wherein said control means includes means for delivering hydraulic fluid under an adjustable pressure to each of said pilot chambers.

6. The hydraulic control valve as defined in claim 5 wherein said biasing means comprises a coil spring positioned under compression in each of said pilot chambers and operatively connected between the associated slide valve and said bore.

7. The hydraulic control valve as defined in claim 6 further comprising pump means for supplying hydraulic fluid under a variable outlet to said inlet lines, and feedback means for delivering the pressure in at least one of said consumer lines to said pump means, and means responsive to said feedback means for adjusting the operation of said pump means to control the output thereof as a function of the pressure in said one consumer line.

8. The hydraulic control valve as defined in claim 7 wherein said feedback means includes a channel formed in said housing and at the periphery of said bore, a feedback line extending from said channel to said pump means, and duct means extending axially through one of said slide valves for establishing communication between the associated consumer line and said channel when said one slide valve is positioned at a predetermined axial location along said bore.

9. The hydraulic control valve as defined in claim 1 wherein said slide valve positioning means includes biasing means operatively connected to each of said first and second slide valves for resiliently supporting the same at said first axial position, and control means for selectively and independently moving each of said slide valves against the force of said biasing means to either said second position or said third position.

10. The hydraulic control valve as defined in claim 9 wherein said cylindrical control shoulder of each of said slide valvee comprises two shoulder sections and a reduced diameter portion between said shoulder sections, and with said shoulder sections being axially spaced apart so as to be adapted to close communication between the associated consumer line and both said tank line and the associated inlet line when the slide valve is positioned at said predetermined first axial position in said bore.

11. The hydraulic control valve as defined in claim 10 wherein the slide valves include respective ends which oppose each other, and with a predetermined clearance between said ends when said slide valves are in said first axial position, and with said clearance being dimensioned such that the ends contact each other only after the consumer line communicating with said portion of reduced diameter between said shoulder sections of at least one slide valve has been opened to said tank line.

12. The hydraulic control valve as defined in claim 11 wherein both slide valves are adapted to axially move a distance sufficient to influence each other, and so that said first and second consumer lines can be interactively controlled through said control means.

13. The hydraulic control valve as defined in claim 9 wherein each of said slide valves further includes a cylindrical slide shoulder which is axially spaced from said control shoulder in the direction extending away from said tank line, and a reduced diameter portion extending between and interconnecting said control shoulder and said slide shoulder.

14. The hydraulic control valve as defined in claim 13 wherein said bore includes a pilot chamber positioned adjacent said slide shoulder of each slide valve, and wherein said control means includes means for delivering hydraulic fluid under an adjustable pressure to each of said pilot chambers.

15. The hydraulic control valve as defined in claim 14 wherein said biasing means comprises a coil spring positioned under compression in each of said pilot chambers and operatively connected between the associated slide valve and said bore.

16. The hydraulic control valve as defined in claim 15 further comprising pump means for supplying hydraulic fluid under a variable output to said inlet lines, and feedback means for delivering the pressure in at least one of said consumer lines to said pump means, and means responsive to said feedback means for adjusting the operation of said pump means to control the output thereof as a function of the pressure in said one consumer line.

17. The hydraulic control valve as defined in claim 16 wherein said feedback means includes a channel formed in said housing and at the periphery of said bore, a feedback line extending from said channel to said pump means, and duct means extending axially through one of said slide valves for establishing communication between the associated consumer line and said channel when said one slide valve is positioned at a predetermined axial location along said bore.

* * * * *